US010989423B2

(12) United States Patent
Guérin et al.

(10) Patent No.: US 10,989,423 B2
(45) Date of Patent: Apr. 27, 2021

(54) STEAM HUMIDIFIER

(71) Applicant: Condair Group AG, Pfäffikon (CH)

(72) Inventors: Camille Jean-Pierre Guérin, Ottawa (CA); Peter C. Thomson, Osgoode (CA)

(73) Assignee: CONDAIR GROUP AG, Pfäffikon (CH)

( * ) Notice: Subject to any disclaimer, the term of this patent is extended or adjusted under 35 U.S.C. 154(b) by 299 days.

(21) Appl. No.: 16/073,072

(22) PCT Filed: Jan. 5, 2017

(86) PCT No.: PCT/CH2017/000002
§ 371 (c)(1),
(2) Date: Jul. 26, 2018

(87) PCT Pub. No.: WO2017/127948
PCT Pub. Date: Aug. 3, 2017

(65) Prior Publication Data

US 2019/0032933 A1 Jan. 31, 2019

(30) Foreign Application Priority Data

Jan. 29, 2016 (CH) ..... 0122/16

(51) Int. Cl.
*F24F 6/02* (2006.01)
*F24F 6/18* (2006.01)
(Continued)

(52) U.S. Cl.
CPC ..... *F24F 6/025* (2013.01); *F24F 6/12* (2013.01); *F24F 6/18* (2013.01); *F22B 1/30* (2013.01)

(58) Field of Classification Search
None
See application file for complete search history.

(56) References Cited

U.S. PATENT DOCUMENTS 1,542,655 A * 6/1925 Ayres ..... F26B 21/08 239/110
3,584,192 A * 6/1971 Maag ..... F24F 6/025 392/406

(Continued)

FOREIGN PATENT DOCUMENTS

CA 2 155 360 A1 2/1997

OTHER PUBLICATIONS

International Search Report for International Application No. PCT/CH2017/000002 dated Jul. 25, 2017.

*Primary Examiner* — Thor S Campbell
(74) *Attorney, Agent, or Firm* — McCormick, Paulding & Huber PLLC

(57) ABSTRACT

A steam generating humidifier apparatus (1) comprises a water container (2) with a water inlet (11) and a steam outlet (12) and at least two elongated electrodes (3, 4) arranged vertically within the container. The electrodes have each an upper electrode end (3', 4') and a lower electrode end (3", 4") and at least one of the electrodes is provided at its lower electrode end with an end piece (15) made of an electrically non-conducting material which end piece is connected to the lower electrode end. This will avoid arcing between the electrode and the water surface in cases where the water level drops so low that the electrodes are exposed.

11 Claims, 3 Drawing Sheets

(51) Int. Cl.
*F22B 1/30* (2006.01)
*F24F 6/12* (2006.01)

(56) References Cited

U.S. PATENT DOCUMENTS 3,659,078 A * 4/1972 Rudstrom ..... F24H 1/00 392/337
3,761,679 A * 9/1973 Dall ..... F22B 1/30 392/331
4,239,956 A * 12/1980 Morton ..... F24F 6/18 126/113
4,394,561 A * 7/1983 Zerbel ..... F24F 6/025 261/142
4,418,269 A * 11/1983 Eaton-Williams ..... F24F 6/025 392/326
4,423,310 A * 12/1983 Zerbel ..... F22B 1/30 338/83
4,675,505 A * 6/1987 Fischer ..... F24F 6/025 236/44 R
5,014,338 A * 5/1991 Glucksman ..... F24F 6/025 200/81.9 R
5,278,937 A * 1/1994 Alix ..... B64D 13/00 261/142
5,313,550 A * 5/1994 Crosnier ..... F24F 6/18 392/325
5,359,692 A * 10/1994 Alix ..... B64D 13/00 219/517
5,361,322 A * 11/1994 Glucksman ..... F24F 6/025 239/138
5,636,319 A * 6/1997 Glucksman ..... F24F 6/025 392/406
6,226,451 B1 * 5/2001 Wong ..... F24F 6/025 261/142
6,345,148 B1 * 2/2002 Chang ..... A43D 95/10 12/1 A
6,938,886 B2 * 9/2005 Glucksman ..... F22B 1/284 261/129
2002/0085839 A1 * 7/2002 Glucksman ..... F24F 6/18 392/405
2002/0154903 A1 * 10/2002 Glucksman ..... F24F 6/18 392/403
2003/0016952 A1 * 1/2003 Elphee ..... F24F 6/18 392/324
2007/0163877 A1 * 7/2007 Brown ..... C25B 15/08 204/297.02
2007/0221630 A1 9/2007 Diedrick
2008/0317447 A1 * 12/2008 Lentz ..... F22B 1/284 392/326
2009/0103904 A1 * 4/2009 Wolff ..... G01F 23/242 392/402
2014/0145358 A1 5/2014 Schwendinger et al.
2014/0145359 A1 5/2014 Schwendinger et al.

* cited by examiner

STEAM HUMIDIFIER

CROSS REFERENCE TO RELATED APPLICATIONS

This application is a National Stage application of International Patent Application No. PCT/CH2017/000002, filed on Jan. 5, 2017, and claims the priority of Swiss patent application no. 0122/16, filed Jan. 29, 2016, the disclosures of which are incorporated herein by reference in their entirety.

TECHNICAL FIELD

The invention relates to electrode steam humidifiers in general and in particular to a steam generating humidifier apparatus comprising a water container with a water inlet and at least one steam outlet and at least two elongated electrodes arranged vertically within the container, said electrodes each having an upper electrode end and a lower electrode end. The invention further relates to an electrode for such a steam humidifier.

BACKGROUND ART

Such electrode steam humidifiers are well known in the art. They can be integrated into central Heating/Ventilating/Air Conditioning (HVAC) systems or can be placed in specified locations for individual room control. These steam humidifiers using electrodes to vaporise water are known for their ease of installation and simplicity of operation and long-term reliability.

SUMMARY OF THE INVENTION

The goal of the present invention is to provide better operation and reliability in case of an unexpected low water level exposing the lower electrode ends.

This goal is achieved by the apparatus described hereafter.

Accordingly, the apparatus includes an electrode being provided with an end piece made of an electrically non-conducting material which is connected to the lower electrode end. This provides a simple and inexpensive yet effective and fail-safe solution preventing effectively any arcing between the electrode and a low-level water surface extending below the electrode. Being a passive solution without electronic sensors and circuits it is fail-safe.

In a preferred embodiment each of the electrodes of the apparatus is provided with an end piece made of an electrically non-conducting material. The electrode with the end piece may be provided such that the end piece covers only the lower end or face, respectively of the electrode without covering the outer surface of the barrel of the electrode. This leaves the electrode surface for transmitting electric energy to the water mainly unaffected. Arcing can be prevented nevertheless, in particular if the diameter of the end piece is larger than the electrode diameter, providing a rim of non-conducting material at the lower electrode end. In a preferred embodiment, however, the end piece is provided with a cap-like shape such as to cover the lower end of the electrode and a part of the outer surface of the barrel of the electrode extending upwardly from the lower end of the electrode. This prevents effectively any arcing that might occur between the barrel of the electrode and the water. To affect the electrode surface active for vaporising water only slightly it is preferred that the end piece covers a part of the outer surface of the barrel of the electrode extending upwardly from the lower end of the electrode in an amount of 1% to 10% of the total length of the electrode.

In a preferred embodiment of the cap-like end piece it is provided with protrusions extending upwardly within the cap shaped end piece which allows for a very simple and secure mounting of the end pieces to the electrodes.

The invention is further based on the goal of providing an electrode for an electrode steam humidifier which provides the advantages explained above.

This goal is met by an electrode comprised by an elongated electrode body made of an electrically conductive material with an end piece made of an electrically non-conductive material at the lower end of the electrode.

Other advantageous embodiments are explained in the description below.

BRIEF DESCRIPTION OF THE DRAWINGS

The invention will be better understood and objects other than those set forth above will become apparent from the following detailed description thereof. Such description makes reference to the annexed drawings, wherein.

DESCRIPTION OF THE PREFERRED EMBODIMENTS

Figure 1:
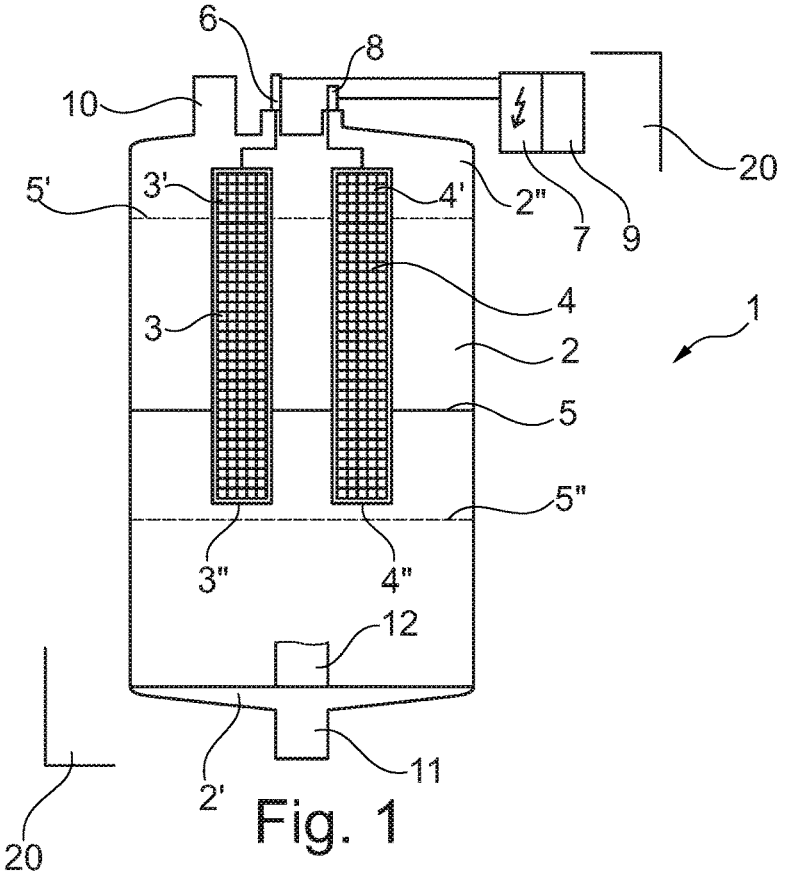
FIG. 1 shows a simplified drawing of a known electrode steam humidifier apparatus.

FIG. 1 shows essential elements of a known electrode steam generating apparatus 1 as far as the elements are of interest for explaining the present invention. The apparatus comprises a vessel or container 2 for the water to be evaporated. An amount of water is shown to be present in FIG. 1 by line 5 indicating the water level. The container 2 has a lower or bottom end 2' and an upper or top end 2", respectively, and the terms "lower" or "bottom" and "upper" or "top" are as well used for other elements in the same meaning. The container 2 is usually arranged within a cabinet or compartment indicated in the drawing only by the frame lines 20. Such a cabinet houses as well the other parts of the steam generating apparatus, in particular a voltage unit 7 feeding electricity to the electrodes and a control unit 9 for controlling the apparatus. It is known in such an apparatus to feed the water to the container 2 from the lower end of the container via a fill connector 11. This connector 11 also allows draining of the container 2 if necessary. A strainer 12 within the container prevents deposits from blocking the draining. Filling may be done by a valve controlled water pipe (not shown) connected to the fill connector 11 and may be under control by the control unit 9. It is also known to have a high water sensor arranged in the upper part of the container and connected to the control unit 9 to prevent overfilling. A high water mark 5' is shown by a dotted line to indicate a possible maximum fill level for the water in the container.

Electrodes are arranged according to FIG. 1 essentially vertically within the container 2 such that their upper ends are not covered by the water. But electrodes of such an apparatus can as well be arranged to be fully submerged in water. In the present example of FIG. 1 two electrodes 3 and 4 with upper ends 3' and 4' are shown. These electrodes are connected to electrical connectors 6 and 8 extending outside of the container 2 and being connected to the voltage unit 7 which provides electrical voltage to the electrodes.

The electrodes are of electrically conducting material and may for example be made of mild galvanised steel mesh. The electrodes transmit electricity to the water in the container. The electricity passing through the water from one electrode to another electrode heats up the water to the point of vaporisation. The water vapour exits through a steam outlet 10 or several steam outlets and will be used for the humidifying purpose for which the apparatus is provided.

Depending on the voltage used and the amount of water to be vaporised the electrode configuration can be selected differently. Larger Electrodes can be selected to increase their surface area and as such the surface contact with the water which allows more electricity to pass, thus heating up the water faster. Likewise smaller electrodes with less surface contact with the water can be selected to limit the electrical energy transmitted to the water and thus reducing the heating of the water. A typical electrode may be in the shape of a hollow cylinder or may be a sector of such a cylinder so that the electrode is shaped like a "piece of pie" when seen in horizontal cross section.

The ease with which the voltage is transmitted to the water across the electrodes can also be influenced by other factors, such as the mineral concentration contained in the water, influencing its conductivity, and by placing elements made of electrically conductive material or made of electrically non-conductive material into the container separate from the electrodes, in order to influence the electrical current path in the water. In particular, it is known, to include non-conducting divider plates into the container when more than two electrodes, for example six "pie-shaped" electrodes are arranged in a container. Such dividers can be included in the apparatus according to the present invention as well but are not described here further.

The electrical current flow through the water is dependent on the surface contact of the electrode and the water. If a situation occurs where the level of the water in the container is lower than the lower faces or ends 3" and 4", respectively of the electrodes (for example the water level indicated by the dotted line 5") water contact by the electrodes is lost. It can be contemplated to detect this state by an electronic circuit analysing the voltage and current at the electrodes or by an additional low water sensor connected to the control unit 9. However, such solutions are rather expensive and may fail. A situation of low water during the humidifying operation may occur by a fault in the water management system due to improper installation or application of the humidifier or due to an improper drain cycle where the water is drained off from the electrodes via drain 11. If the water level drops below the lower faces 3" and 4" of the electrodes, electric arcs may develop between the electrodes and the water surface. Prolonged arcing will damage the electrodes and can as well damage the apparatus as a whole and results in hazardous operation of the humidifier.

Figure 2:
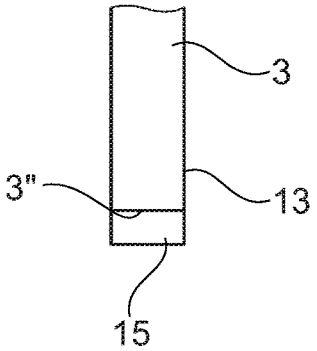
FIG. 2 shows the lower part of an electrode of a steam generating humidifier apparatus according to the invention with an end piece made of electrically non-conducting material.

According to the present invention a simple and inexpensive yet effective and fail-safe solution is provided. Accordingly, at the lower end of each electrode an end piece or tip, respectively, is added which is made of an electrically non-conductive material. This prevents arcing effectively and being a passive solution without electronic sensors and circuits it is fail-safe. FIG. 2 shows the principle by showing only the lower part of electrode 3 with its end or face 3", respectively, and an end piece 15 made from an electrically non-conducting material such a plastic or ceramic material that is connected to the end face 3" of electrode 3. This embodiment of an end piece just covers the end face 3" of the electrode 3 without covering the outside 13 of the electrode 3 other than the face 3". In case of the cylindrical electrode the full cylinder barrel surface is still active as the electrode surface in this embodiment with the end piece 15. Such an end piece 15 will be fixed to the electrode during its manufacture by a glue or by a mechanical fixation such as screwing or riveting. The end piece 15 of FIG. 2 can be a closed disc shaped piece or can be shaped as a ring having a centre opening. The end piece 15 may as well extend in radial direction from the electrode so that the diameter of the end piece is larger than the diameter of the electrode. In FIG. 2 only one electrode is shown as an example but both electrodes of FIG. 1 would be so equipped.

FIGS. 3 to 6 show another embodiment of an end piece for the electrodes, here as well with the example of electrode 3 being an essentially hollow cylindrical electrode. The electrodes of FIGS. 2 to 4 and 9 are still preferably steel mesh electrodes as mentioned before, but the mesh structure is not shown in the Figures in order to simplify the drawings. In this preferred embodiment the end piece 15 is shaped like a cap which fits over the outside 13 of the electrode barrel at the end 13' thereof, thus covering the face 3" of the electrode as well as the outside of the electrode as far as the end piece extends towards the top of the electrode. A dotted line 18 in FIG. 3 indicates, just and only for the sake of clarity in the drawing, how far the end piece 15 will extend over the electrode end when the cap-shaped end piece is completely mounted over the end of the electrode. The cap-like end piece may cover only a very small amount of the total length of the outside of the electrode, preferably in the range of 1% to 10% of the total length of the electrode, in order to keep the electrode surface as great a possible for normal steam generating operation but still to avoid arcing in case of a loss of water contact by the electrodes.

Figure 6:
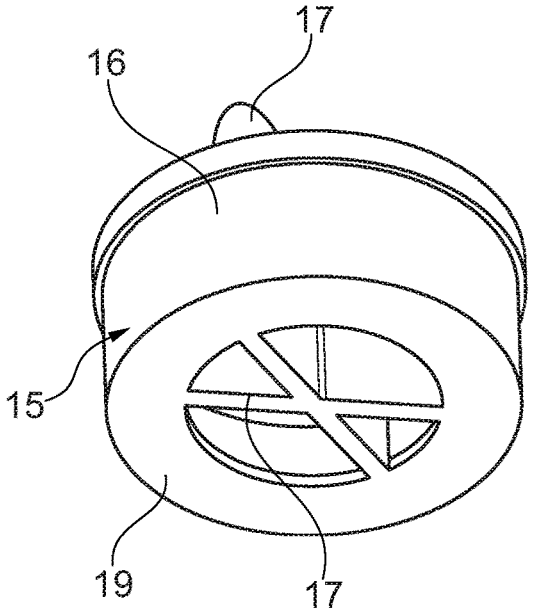
FIG. 6 shows the end cap of FIG. 5 as seen from its bottom end.

The cap-like end piece 15 will as well cover the face 3" of the electrode by the lower rim 19 of the cap-like end piece, which can be seen in FIG. 6. The cap-like end piece 15 may be glued or otherwise fixed to the outer surface of the electrode. The end piece may be kept as well in connection with the electrode by friction force alone. In a preferred embodiment the cap-like end piece 15 may be provided with internal protrusions or wings 17 which will fit into the hollow electrode and which will contact the inner side of the electrode. This will improve friction force fixation of the end piece and will result in a very simple manufacture of the electrodes with their end-piece.

Figure 3:
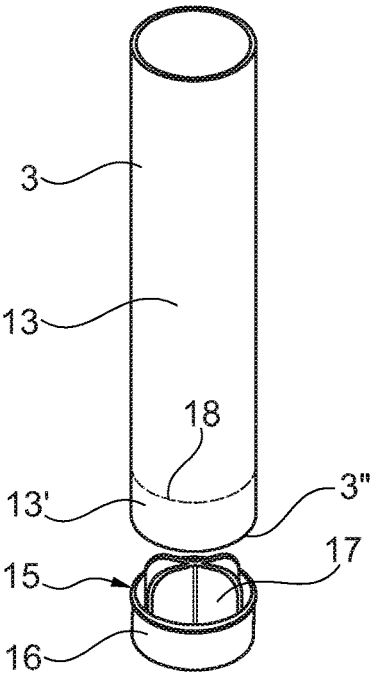
FIG. 3 shows another embodiment with a lower end cap shown in a position separate from the electrode, before mounting of this end piece to the electrode.
Figure 4:
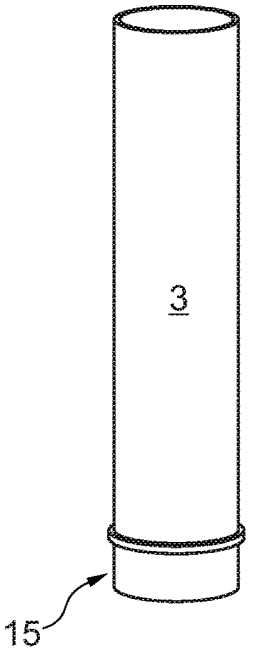
FIG. 4 shows the electrode of FIG. 3 with the end cap shown in place on the electrode.
Figure 5:
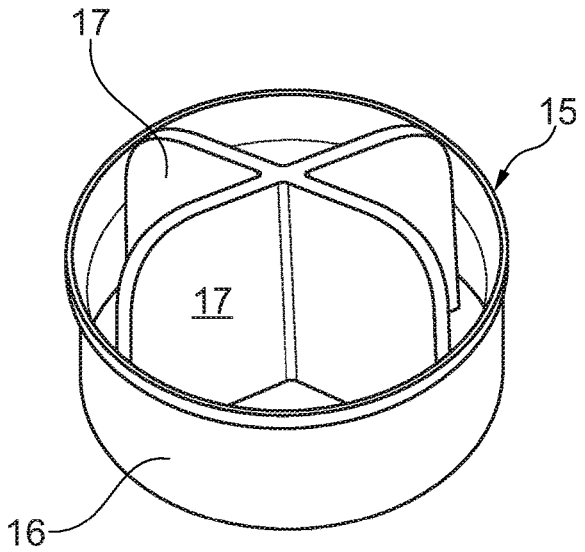
FIG. 5 shows the end cap of FIGS. 3 and 4 in detail as seen from end cap's top end to be introduced into the electrode.

FIG. 3 shows the electrode 3 and the end-piece 15, in an embodiment with protrusions 17, before connecting electrode and end piece, and FIG. 4 shows the electrode with the end-piece fitted. FIGS. 5 and 6 show the end-piece 15 in more detail. It can be seen that the end-piece has a bottom rim 19 which covers the face of the electrode. The end-piece can be made of any suitable electrically non-conductive material such as plastic material or ceramic material.

Figure 7:
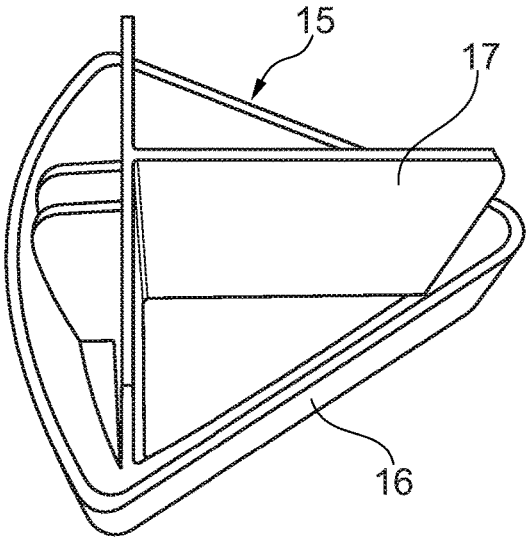
FIG. 7 shows an end cap of different shape for an electrode with a cross section having essentially the shape of a sector of a circle or being "piece of pie shaped", respectively.
Figure 8:
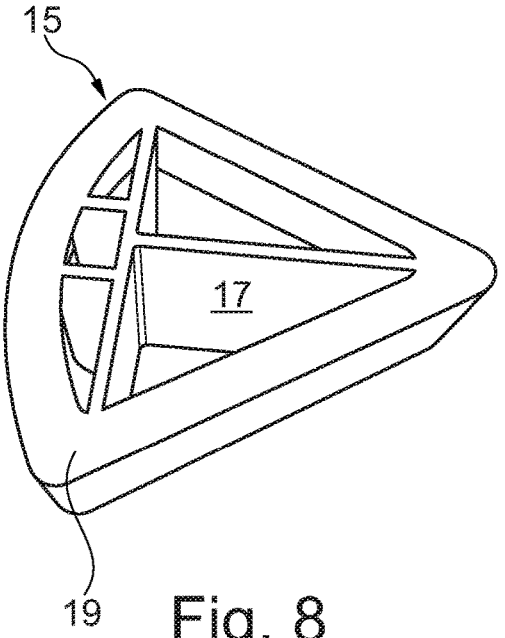
FIG. 8 shows the end cap of FIG. 7 as seen from its bottom side.
Figure 9:
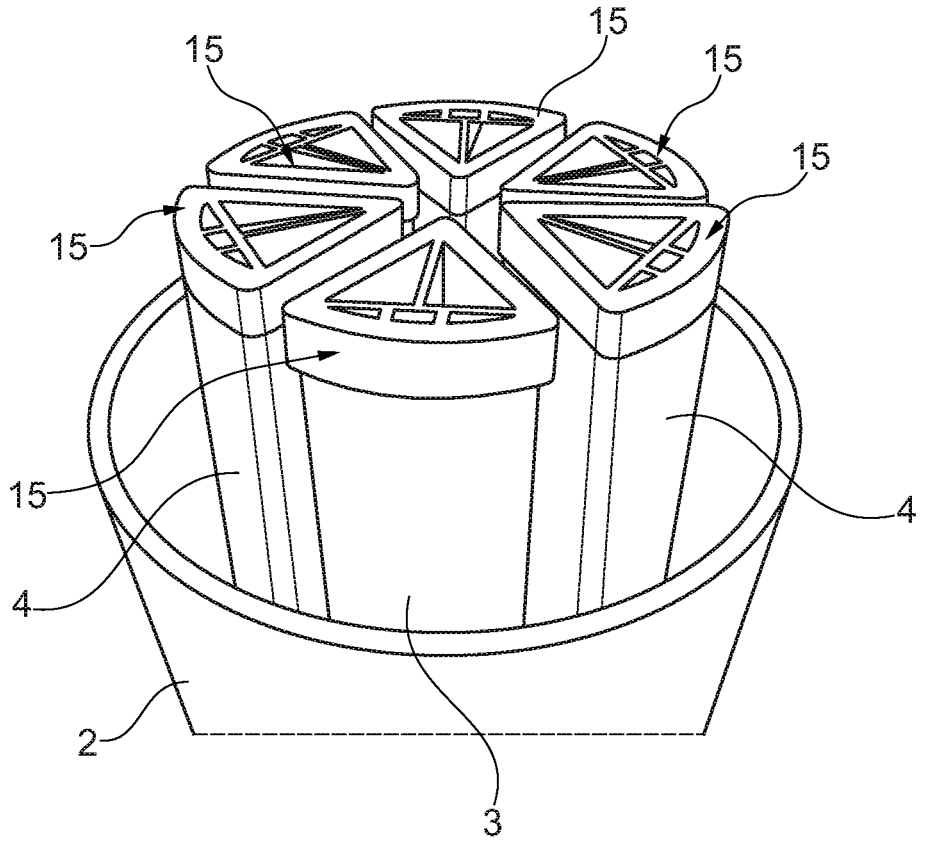
FIG. 9 shows a bottom view of six electrodes arranged in the still open vessel of the apparatus with end caps according to FIGS. 7 and 8.

FIGS. 7 to 9 show an embodiment with "piece of pie" shaped electrodes and the corresponding end pieces. Same reference numerals as used before show same elements and the description of these elements given above applies mutatis mutandis to the end-pieces and the electrodes of FIGS. 7 to 9 as well. FIG. 9 shows the container 2 in an open state and downside up so that the electrodes and end-pieces 15 are viewed from their lower side. Of course in the assembled state of the apparatus the container is closed and turned 180 degrees so that it is positioned as in FIG. 1. As said before, the electrodes shown in FIG. 9 are preferably steel mesh electrodes but the mesh structure is not shown in FIG. 9.

The cap-like end pieces of this embodiment may cover as well only a very small length of the outside of the electrodes in the range of 1% to 10% of the total length of the electrodes in order to keep each electrode surface as great a possible for normal steam generating operation but still to avoid arcing in case of a loss of water contact by the electrodes.

Although various embodiments of the present invention have been described and shown, the invention is not restricted thereto, but may also be embodied in other ways within the scope of the subject-matter defined in the following claims.

What is claimed is:

1. A steam generating humidifier apparatus (1), comprising a water container (2) with a water inlet (11) and at least one steam outlet (10) and at least two elongated electrodes (3, 4) arranged vertically within the container, said electrodes each having an upper electrode end (3', 4') and a lower electrode end (3", 4"), characterized in that at least one of the electrodes has an outer surface extending upward from the lower electrode end, and is provided at its lower electrode end with an end piece (15) made of an electrically non-conducting material which end piece is connected to the lower electrode end, and has a cap-like shape covering the lower end of the electrode and a part of the outer surface of the electrode extending upward from the lower end.

2. The apparatus according to claim 1, wherein the end piece covers a part (13') of the outer surface (13) of the electrode extending upwardly from the lower end (3") of the electrode in an amount of from 1% to 10% of the total length of the electrode.

3. The apparatus according to claim 1, wherein the end piece (15) is provided with protrusions (17) extending upwardly within the cap shaped end piece.

4. The apparatus according to claim 1 wherein the electrodes are hollow cylindrical electrodes and the cap-shaped end pieces are cylindrically shaped as well.

5. The apparatus according to claim 1 wherein the electrodes are shaped as sections of a hollow cylinder and the end pieces are pie-shaped.

6. The apparatus according to claim 1, wherein the electrodes are hollow cylindrical electrodes and the end pieces are cylindrically shaped as well.

7. An apparatus according to claim 1, wherein the elongated electrode body is made of mild galvanized steel mesh.

8. An apparatus according to claim 1, wherein the cap-shaped end piece is made of an electrically non-conductive plastic or ceramic material.

9. An electrode (3) for a steam generating humidifier apparatus, comprising: an elongated electrode body made of an electrically conductive material, having an upper end (3') and a lower end (3") for vertical installation in a steam generating humidifier apparatus, and being provided with an end piece made of an electrically non-conductive material, the end piece having a cap-like shape covering the lower end of the electrode as well as from 1% up to 10% of the total length of the electrode at the lower end.

10. An electrode (3) according to claim 9, wherein the elongated electrode body is made of mild galvanized steel mesh.

11. An electrode (3) according to claim 9, wherein the cap-shaped end piece is made of an electrically non-conductive plastic or ceramic material.

* * * * *